US011503979B2

(12) United States Patent
Porcelli

(10) Patent No.: US 11,503,979 B2
(45) Date of Patent: Nov. 22, 2022

(54) DEVICE FOR DRYING AND POLISHING ITEMS SUCH AS GLASSES AND CUTLERY

(71) Applicant: MT Innovations Pty Ltd, Melbourne (AU)

(72) Inventor: Tommaso Porcelli, Ventimiglia (IT)

(73) Assignee: MT Innovations PTY LTD, Melbourne (AU)

( * ) Notice: Subject to any disclaimer, the term of this patent is extended or adjusted under 35 U.S.C. 154(b) by 817 days.

(21) Appl. No.: 16/466,577

(22) PCT Filed: Dec. 22, 2017

(86) PCT No.: PCT/AU2017/051445
§ 371 (c)(1),
(2) Date: Jun. 4, 2019

(87) PCT Pub. No.: WO2018/129579
PCT Pub. Date: Jul. 19, 2018

(65) Prior Publication Data

US 2019/0350436 A1 Nov. 21, 2019

(30) Foreign Application Priority Data

Jan. 10, 2017 (AU) ..... 2017900049

(51) Int. Cl.
*A47L 21/02* (2006.01)
*A47L 15/00* (2006.01)
*A47L 15/42* (2006.01)

(52) U.S. Cl.
CPC ..... *A47L 21/02* (2013.01); *A47L 15/0013* (2013.01); *A47L 15/0015* (2013.01);
(Continued)

(58) Field of Classification Search
CPC ..... A47L 21/02; A47L 15/0068
See application file for complete search history.

(56) References Cited

U.S. PATENT DOCUMENTS 872,702 A 12/1907 Vodoz
2,029,855 A * 2/1936 Chambers ..... A47L 15/0068 15/101

(Continued)

FOREIGN PATENT DOCUMENTS

CN 201333018 Y 10/2009
CN 103272810 B 1/2016
WO 03-009965 A2 2/2003

OTHER PUBLICATIONS

International Publication Number dated Jul. 19, 2018 in International Patent Application No. PCT/AU2017/051445 filed Dec. 22, 2017, all pages.

(Continued)

*Primary Examiner* — Spencer E. Bell
(74) *Attorney, Agent, or Firm* — Armstrong Teasdale LLP

(57) ABSTRACT

A device for drying and polishing items such as glasses and cutlery, the device including an enclosure having apertures through which an end of the items can be inserted; a plurality of movable cleaning elements within the enclosure for drying and/or polishing the items; and a selectively operable steam distribution system for applying steam within the enclosure to at least one of the cleaning elements and/or the items, whereby the cleaning elements dry or polish the items, wherein the steam distribution system is operable on insertion of an end of said items into the enclosure.

19 Claims, 8 Drawing Sheets

(52) U.S. Cl.
CPC ..... *A47L 15/4257* (2013.01); *A47L 2501/14* (2013.01); *A47L 2501/36* (2013.01)

(56) References Cited

U.S. PATENT DOCUMENTS

| | | | | |
|---|---|---|---|---|
| 3,315,294 | A * | 4/1967 | Gallo | A47L 15/39 15/164 |
| 3,516,108 | A | 6/1970 | Loeffler | |
| 3,520,726 | A * | 7/1970 | Gay | B65G 29/02 134/115 R |
| 3,866,265 | A * | 2/1975 | Beazley | A47L 15/0068 15/75 |
| 8,506,360 | B1 | 8/2013 | Larson | |
| 2008/0099043 | A1 * | 5/2008 | Barnhill | A47K 7/04 15/4 |
| 2014/0259515 | A1 | 9/2014 | Nuttall et al. | |

OTHER PUBLICATIONS

International Search Report and Written Opinion dated Jul. 19, 2018 in International Patent Application No. PCT/AU2017/051445 filed Dec. 22, 2017, all pages.

International Preliminary Report On Patentability dated Jan. 17, 2019 in International Patent Application No. PCT/AU2017/051445 filed Dec. 22, 2017, all pages.

* cited by examiner

DEVICE FOR DRYING AND POLISHING ITEMS SUCH AS GLASSES AND CUTLERY

FIELD OF THE INVENTION

The present invention relates to a device for drying and/or polishing items such as glasses and cutlery.

BACKGROUND OF THE INVENTION

Drying and polishing cutlery and glasses is a necessary part of hospitality as streaks and spots are commonly present after cleaning, particularly by a dishwasher. Due to a lack of an effective commercial solution, drying and polishing cutlery is commonly performed manually with a rag, by engaging the item by hand and wiping it with the rag, which can be time consuming and also creates potential hygiene issues if 15 not performed carefully and diligently.

Devices for drying and polishing items such as glasses and cutlery have previously been proposed but have generally been ineffective, complicated and generally inconvenient to use. For example, the device disclosed in EP1532921 can only handle cutlery and not glasses. U.S. Pat. No. 6,907,893 is configured for cleaning bottles within a sealed enclosure and would not be appropriate for use in rapidly drying and polishing glasses and cutlery, neither would U.S. Pat. No. 7,604,012, which also includes means for washing the items.

Furthermore, previous devices have suffered from a lack of control of steam within the devices and appropriate safety features to enable widespread commercial use.

Examples of the invention seek to solve, or at least ameliorate, one or more disadvantages of previous devices for drying and polishing items such as glasses and cutlery, or at least provide a useful alternative.

SUMMARY OF THE INVENTION

According to one aspect of the invention there is provided a device for drying and polishing items such as glasses and cutlery, the device including:

an enclosure having apertures through which an end of the items can be inserted;

a plurality of movable cleaning elements within the enclosure for drying and/or polishing the items; and a selectively operable steam distribution system for applying steam within the enclosure to at least one of the cleaning elements and/or the items, whereby the cleaning elements dry or polish the items, wherein the steam distribution system is operable on insertion of an end of said items into the enclosure.

According to a preferred embodiment, the cleaning elements are rotatable for cleaning or polishing the items. Preferably, the steam distribution system is operable by applying pressure to the cleaning elements axially along their axis of rotation.

At least one of the cleaning elements is preferably mounted on a rotatable shaft, the shaft rotating around a steam pipe extending through the shaft and terminating at a steam nozzle formed by apertures in the shaft intermediate of its length. A conical diffuser can be disposed at an end of the steam pipe to direct steam radially outwardly from the steam pipe and into the cleaning element.

According to another aspect of the invention there is provided a device for drying and polishing items such as glasses and cutlery, the device including:

an enclosure having apertures through which an end of the items can be inserted;

a plurality of movable cleaning elements within the enclosure for drying and/or polishing the items; and a selectively operable steam distribution system for applying steam within the enclosure to at least one of the cleaning elements and/or the items, whereby the cleaning elements dry or polish the items, wherein at least one of the cleaning elements is mounted on a rotatable shaft, the shaft rotating around a steam pipe extending through the shaft and terminating at a steam nozzle formed by apertures in the shaft intermediate of its length, and wherein a conical diffuser is disposed at an end of the steam pipe and within the cleaning element to direct steam radially outwardly from the steam pipe and into the cleaning element.

Preferably, with this aspect the steam distribution system is operable by applying pressure to the cleaning elements axially along their axis of rotation.

According to preferred embodiments of either one of the above aspects, at least one rotatable shaft is axially movable with respect to a corresponding steam pipe to operate the steam distribution system. Preferably, the rotatable shaft is resiliently biased upwardly and movable downwardly to operate the steam distribution system.

The steam distribution system may be operable upon an end of one of said items being brought into contact with at least one cleaning element. Preferably, the steam distribution system is operable on applying pressure to at least one of the cleaning elements via applying pressure to the item once inserted within the enclosure.

Preferably, the device has an openable cover in which the apertures are formed, the device being configured to cease operation on opening of the cover.

The device can further include a programmable microprocessor, wherein the microprocessor is configured to record usage history and provide alerts for replacement of the cleaning elements once a predetermined number of cycles have passed.

BRIEF DESCRIPTION OF THE DRAWINGS

Preferred embodiments of the invention will be further described, by way of non-limiting example only, with reference to the accompanying drawings in which.

DETAILED DESCRIPTION

Figure 1:
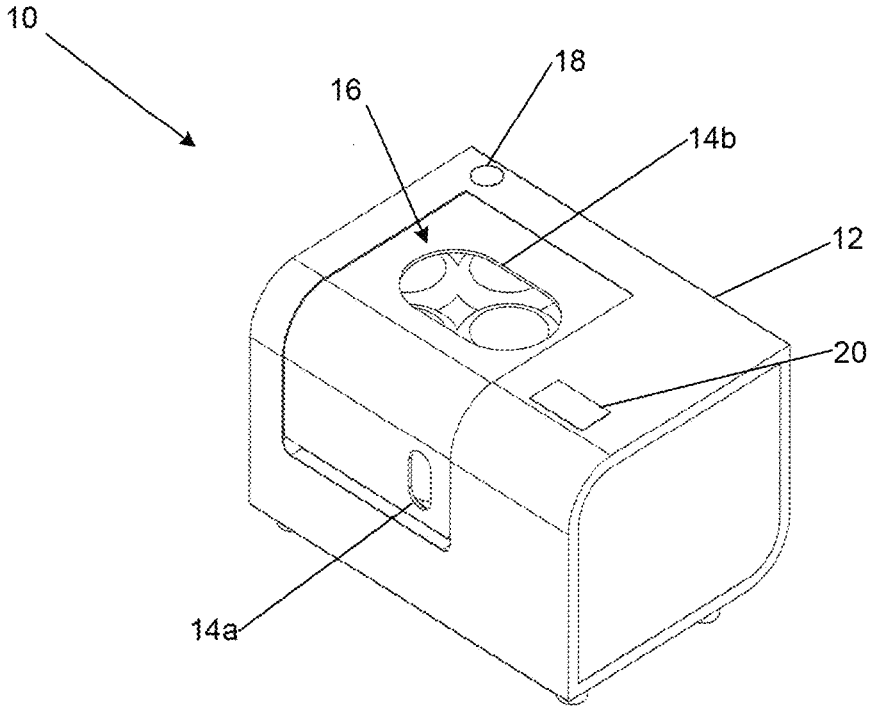
FIG. 1 is a perspective view of a device of one embodiment of the invention.

With reference to FIG. 1, there is shown a device 10 for drying and polishing items such as glasses and cutlery according to a preferred embodiment of the invention.

The device includes an enclosure 12 having apertures 14*a*, 14*b* through which an end of the items can be inserted, a plurality of movable cleaning elements 16 within the enclosure 12 for drying and/or polishing the items, and a selectively operable steam distribution system 34 (to be described further below) for applying steam within the enclosure 12 to at least one of the cleaning elements 16 and/or the items, whereby the cleaning elements 16 dry and/or polish the items.

Figure 2:
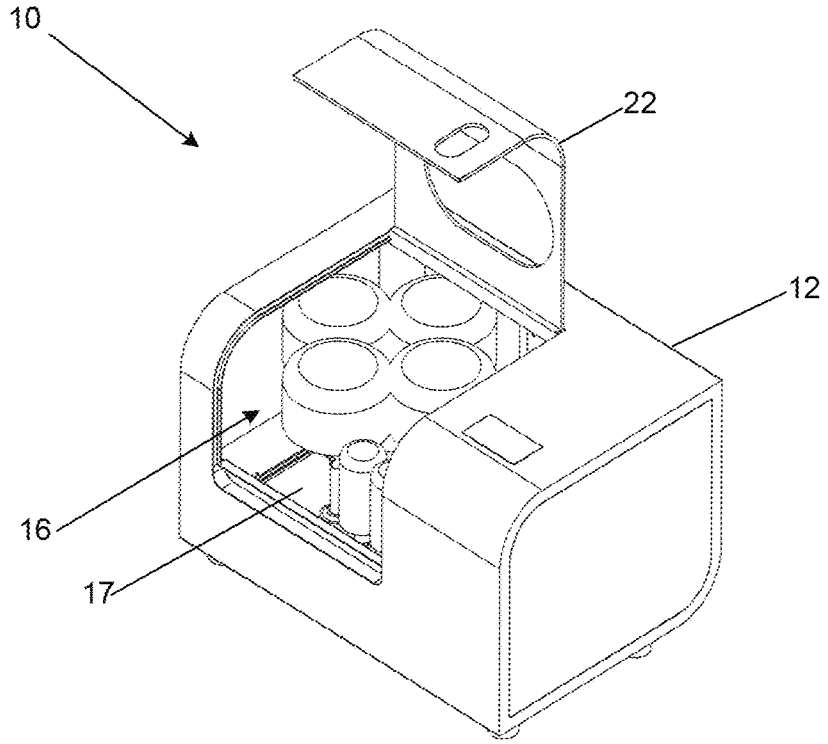
FIG. 2 is a perspective view of the device with an enclosure cover opened.
Figure 3:
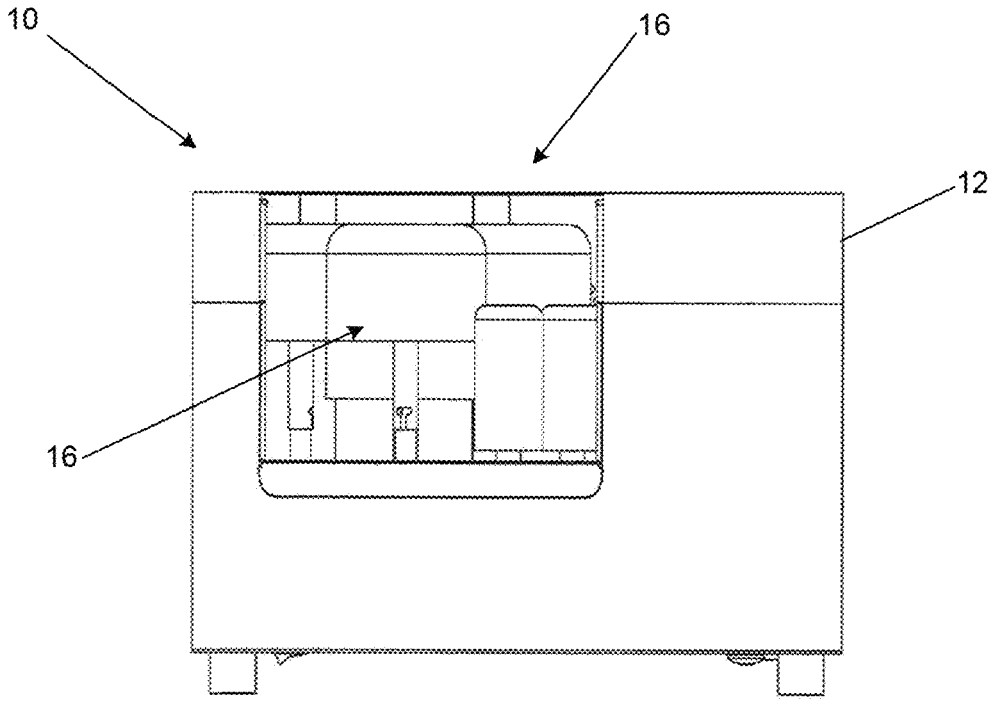
FIG. 3 is a side view of the device with the cover removed.
Figure 4:
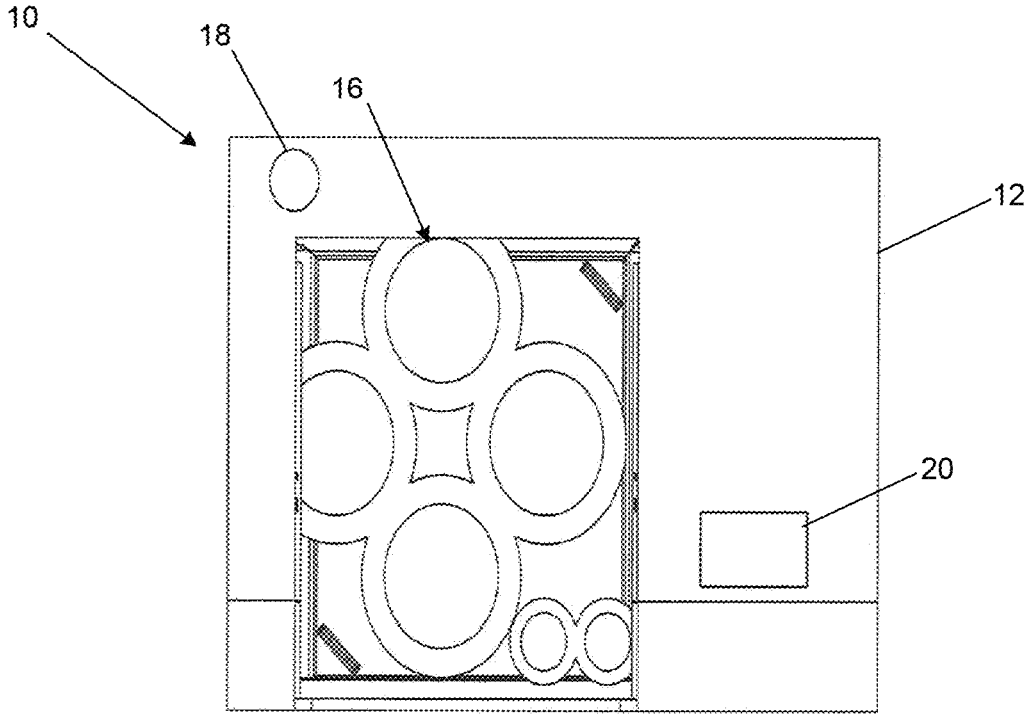
FIG. 4 is a plan view of the device with the cover removed.

The enclosure 12 is fitted with an operation switch 18 and a display screen 20, which may be in the form of a LCD screen. The enclosure 12 also includes a lid 22, openable, as illustrated in FIG. 2, for access to an internal area of the device 10 and the cleaning elements 16. The device 10 is preferably configured to cease operation on opening of the lid 22. To facilitate cleaning, a removable rubber tray 17 is received in a base of the enclosure 12 for collecting debris.

Figure 5:
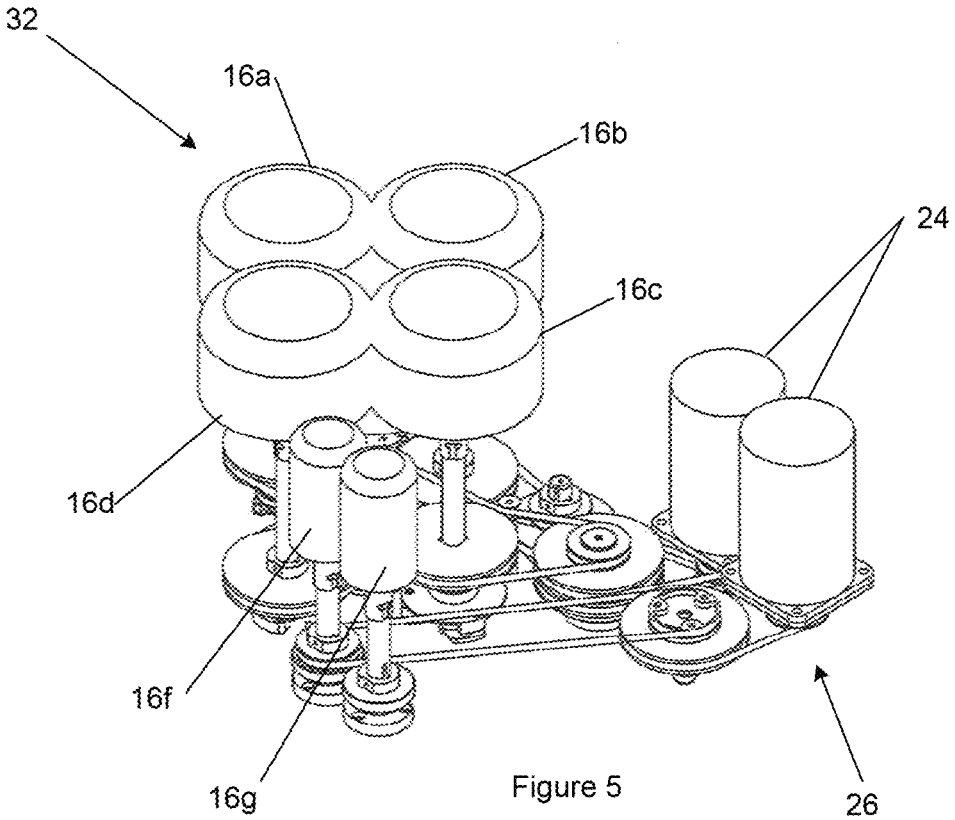
FIG. 5 is a perspective view of a rotating assembly removed from the device.
Figure 6:
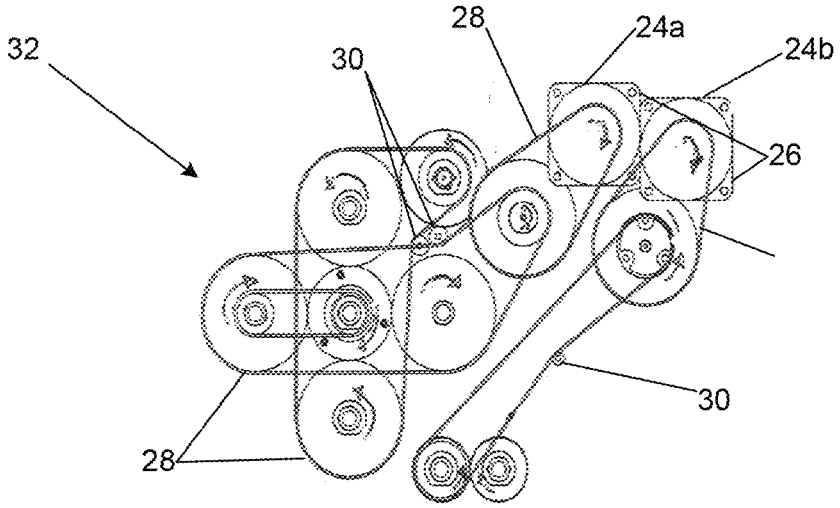
FIG. 6 is an underneath view of the rotating assembly.

FIGS. 5 and 6 illustrate a rotating assembly 32 of the device 10 in more detail. In the embodiment illustrated, the cleaning elements 16 are driven from two electric drives 24, which may take any commercially available form. As shown in FIG. 6, a first electric drive is configured for driving a first set of cleaning elements 16*a*, 16*b*, 16*c*, 16*d*, 16*e* configured for drying/polishing glasses, and a second electric drive is configured for driving a second set of cleaning elements 16*f*, 16*g* configured for drying/polishing cutlery. Of the first set of cleaning elements, cleaning element 16*a* is centrally disposed and configured for cleaning an internal area of a glass, while cleaning elements 16*b*, 16*c*, 16*d*, 16*e* are configured for cleaning an external area. It should be noted that in FIGS. 1 to 5, 7 and 8, central cleaning element 16*a* has been removed for clarity. Also, in an alternative configuration, a single electric drive may be used in conjunction with a system for selectively engaging the first and second sets of cleaning elements as required.

The electric drives 24 rotate pulleys 26 which, via belts 28, causes rotation of the shafts on which the cleaning elements 16 are mounted. Idlers 30 may be provided for guiding/directing the belt. Preferably, some of the cleaning elements 16 within the first and second sets are configured for counter rotation to improve drying/polishing of the glasses/cutlery. To achieve this, gears may be used to couple cleaning elements or other components within the rotating elements and transfer rotational direction as required.

It will be appreciated that not all of the cleaning elements 16 need be directly rotated by belts 28 and that some of the cleaning elements, such as cleaning elements 16*f*, 16*g* illustrated, may instead be coupled to a driven cleaning element by gears to enable rotation and to transfer the direction of rotational motion from one cleaning element to the next.

Figure 7:
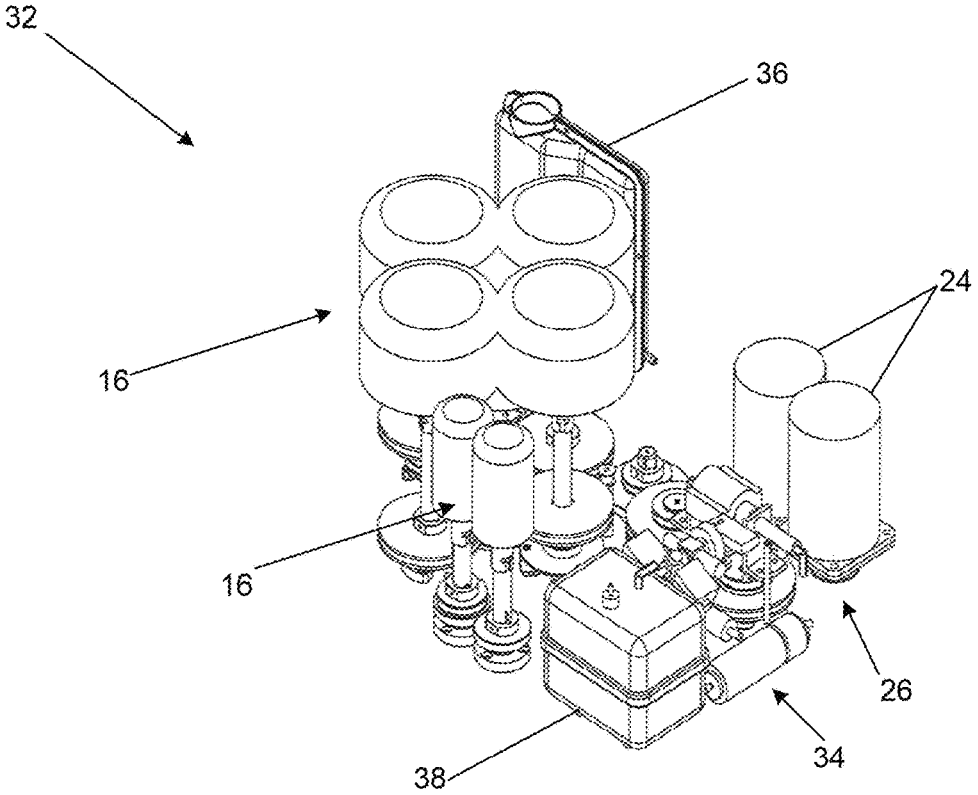
FIG. 7 is a perspective view of the internal components of the device.
Figure 8:
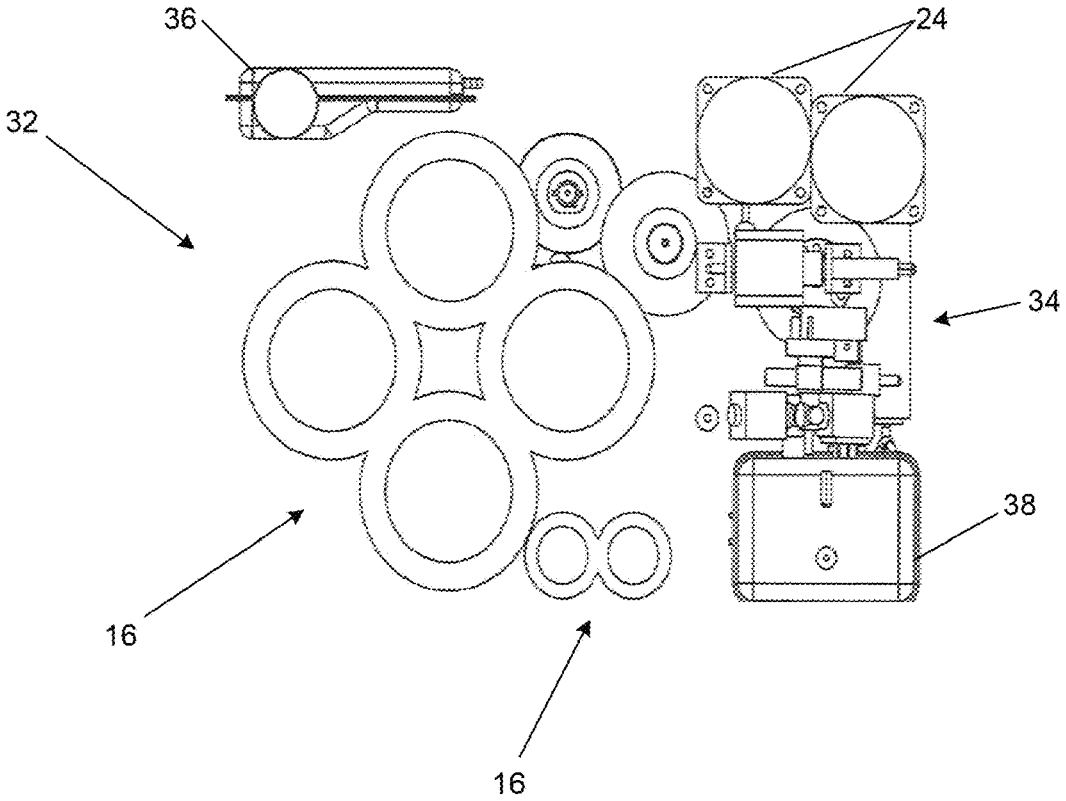
FIG. 8 is a plan view of the internal components of the device.

FIGS. 7 and 8 illustrate the rotating assembly 32 with a steam distribution system 34 fitted thereto. The steam distribution system 34 includes a water reservoir 36, though in other embodiments, such as that shown in FIG. 10, a mains water connection 37 may be provided. The steam distribution system 34 includes a boiler 38 for heating the water, a pump 42, and valves for distributing the steam and maintaining a required pressure in the system.

Figure 9:
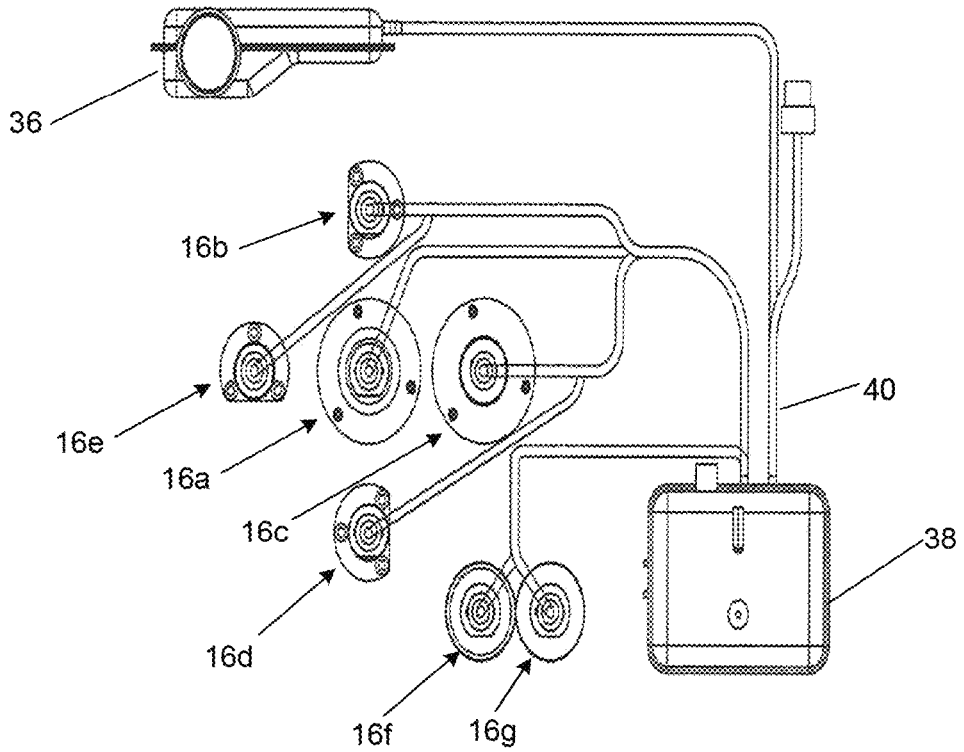
FIG. 9 is a schematic layout drawing of a steam generation system of the device.
Figure 10:
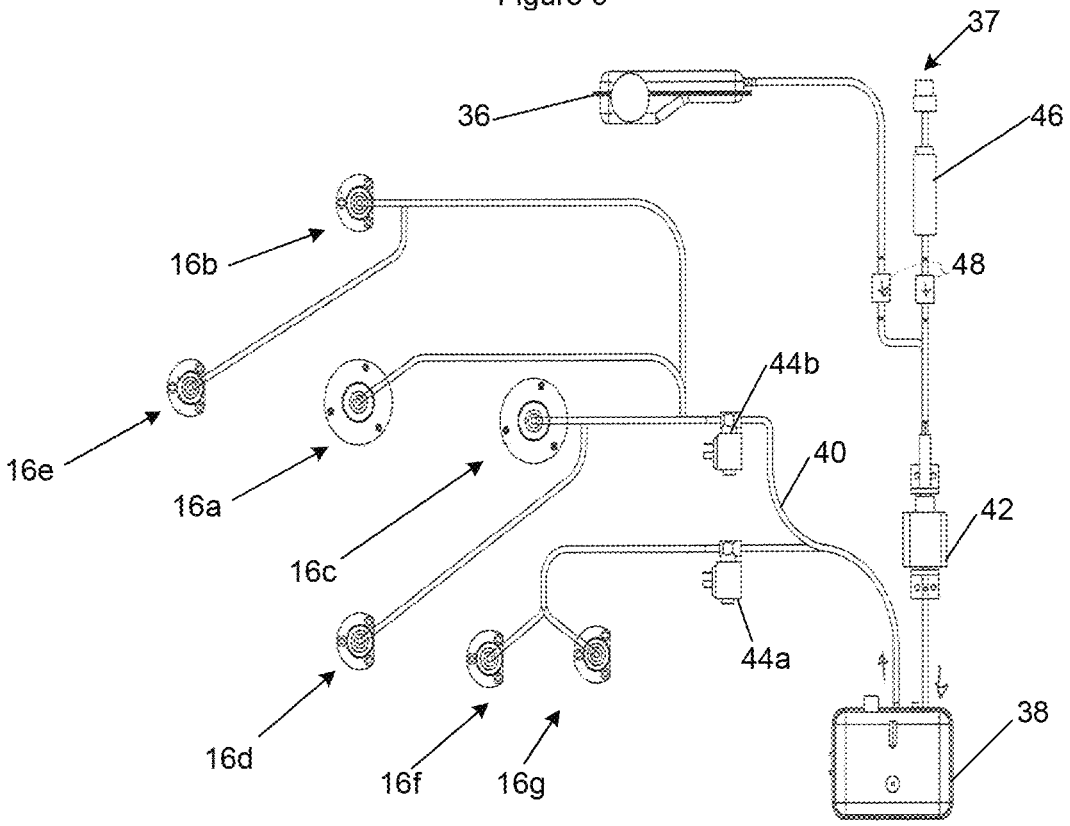
FIG. 10 is a detailed layout drawing of the steam generation system.

FIGS. 9 and 10 schematically illustrate the interaction between the steam distribution system 34 and the cleaning elements 16. It can be seen that each cleaning element is in communication with the boiler 38 via conduits 40 so that steam can be distributed onto the cleaning element 16 or directly onto the item to be dried/polished. In other embodiments, not every cleaning element may be in communication with the boiler 38 for the distribution of steam. In such examples, cleaning elements may be steam free, or a steam nozzle may be disposed proximal to a number of cleaning elements and provide steam either onto the cleaning elements or directly onto the item.

A pump 42 is provided for distributing the steam. Control valves 44*a*, 44*b* are also provided to control distribution of steam between cleaning elements configured for use with cutlery and cleaning elements for use with glasses.

For safety, a pressure reducer 46 is provided on a mains water intake, with one way valves 48 used to control flow of water from the reservoir 36 (or water intake) and to the pressure reducer 46. Also, a flow limiter may be provided to limit the amount of steam that can be applied within the enclosure 12.

The steam distribution system 34 is operable on detection of an end of said items being inserted into the enclosure 12. In some embodiments, sensors may be used to detect an end of said items being inserted into the enclosure 12. In the illustrated embodiment, the steam distribution system 34 is operable upon an end of one of said items being brought into contact with at least one cleaning element 16. In this regard, the steam distribution system 34 is operable on applying pressure to at least one of the cleaning elements 16 via applying pressure to the item once inserted within the enclosure 12, for example by pressing an upturned glass downwardly onto a cleaning element.

Within the cleaning elements for use with glasses, only some of the rotating elements may be configured as "switchable", i.e. configured so that by applying pressure thereto causes activation of the steam distribution system 34. In the illustrated example, only internal cleaning element 16*a*, which is configured for cleaning the inside of a glass, and external cleaning element 16*c*, which is configured for cleaning an external area of the glass are so configured, with cleaning elements 16*b*, 16*d*, 16*e* being provided without a switch. Exerting pressure on either cleaning element 16*a* or 16*c* will result in steam being applied to all of the cleaning elements in the first set, i.e. 16*a*, 16*b*, 16*c*, 16*d* and 16*e*, resulting in both external and internal cleaning of the glass.

With "unswitched" cleaning elements 16*b*, 16*d*, 16*e* steam can still be applied to those cleaning elements, though the steam is only applied on operation of the switches associated with cleaning elements 16*a*, 16*c*. Such an arrangement can reduce manufacturing costs and complexity without adversely affecting performance.

Figure 11:
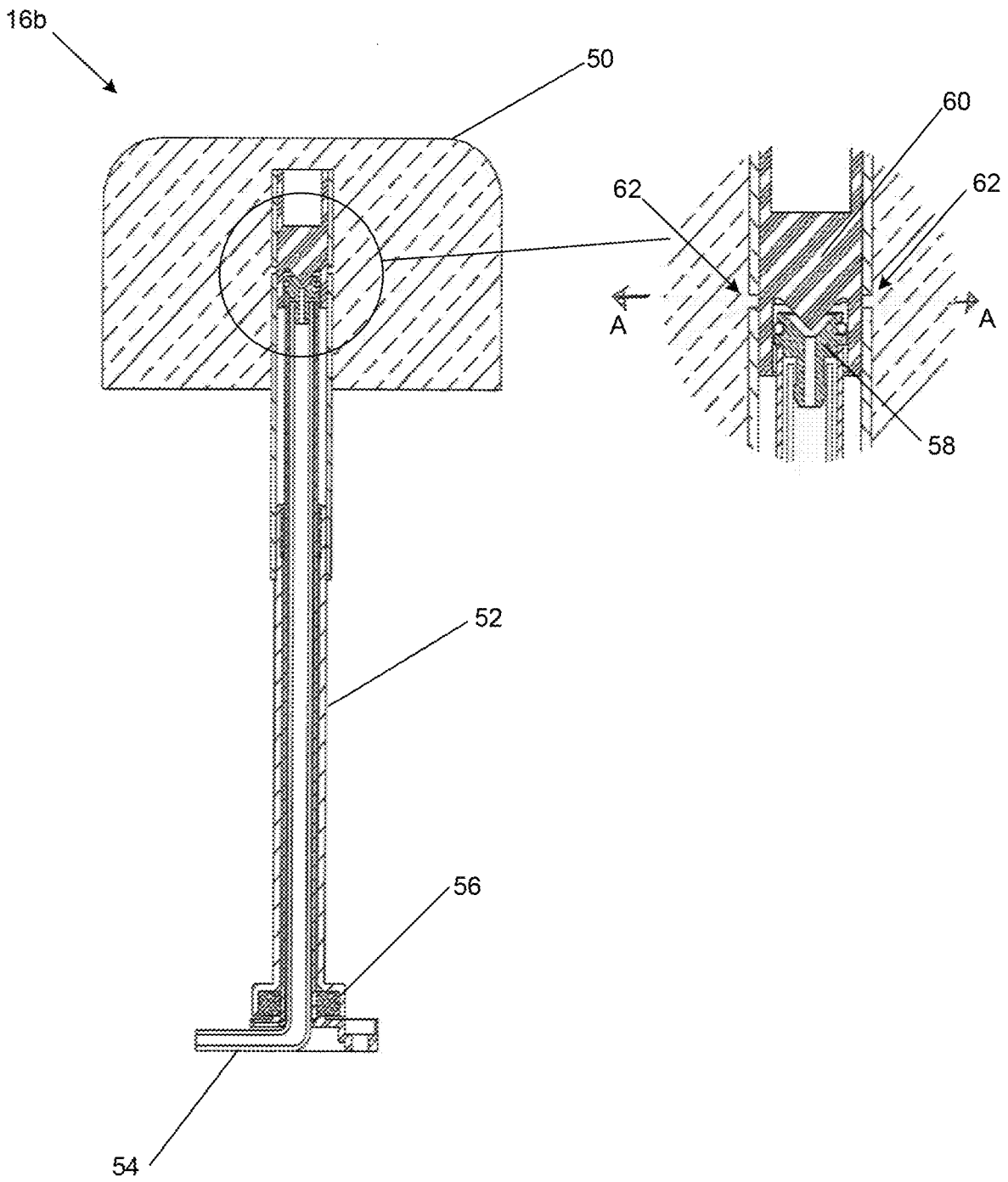
FIG. 11 is a side sectional view of a shaft for supporting a cleaning element.

FIG. 11 illustrates unswitched cleaning element 16*b* in further detail. It will be appreciated that cleaning elements 16*d*, 16*e* may be similarly configured. Cleaning element 16*b* includes a cleaning head 50 for engaging the item to be polished, in this case a glass. The cleaning head 50 is formed of flexible filaments, which may be cotton, that are urged outwardly during rotation. In other embodiments, the cleaning elements may be formed of other materials, such as plastic foams for example. The cleaning head 50 is mounted on a shaft 52 that rotates about steam pipe 54. A bearing 56 may be provided to support the shaft 52.

At the top of the steam pipe 54 is a nozzle 58 that directs steam onto a conical diffuser 60, which rotates with the cleaning head 50, for directing steam radially outwardly along path A from the steam pipe 54 via apertures 62 formed in shaft 52. Steam flows through apertures 62 and into cleaning head 50 to facilitate drying and polishing of the glass. The apertures are preferably two apertures offset 180 degrees around the shaft, i.e. on opposite sides of the shaft, though they may also be otherwise configured with a single aperture or more than two apertures. Although a single set of apertures is provided at a mid point of the cleaning element, it will be appreciated that they may be offset from the mid point, and that more that one set of apertures may be provided.

Figure 13:
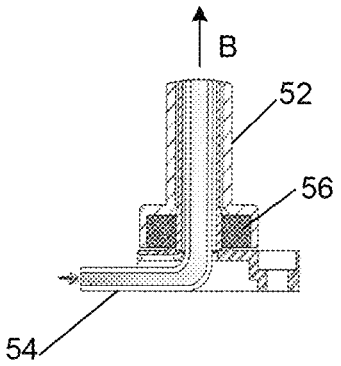
FIG. 13 is a side sectional view of a base of a shaft for supporting a cleaning element.

On activation of the steam distribution system 34, steam flows from the boiler 38, via the conduit 40, into steam pipe 54 and upwardly along path B, as illustrated in FIG. 13.

Figure 12:
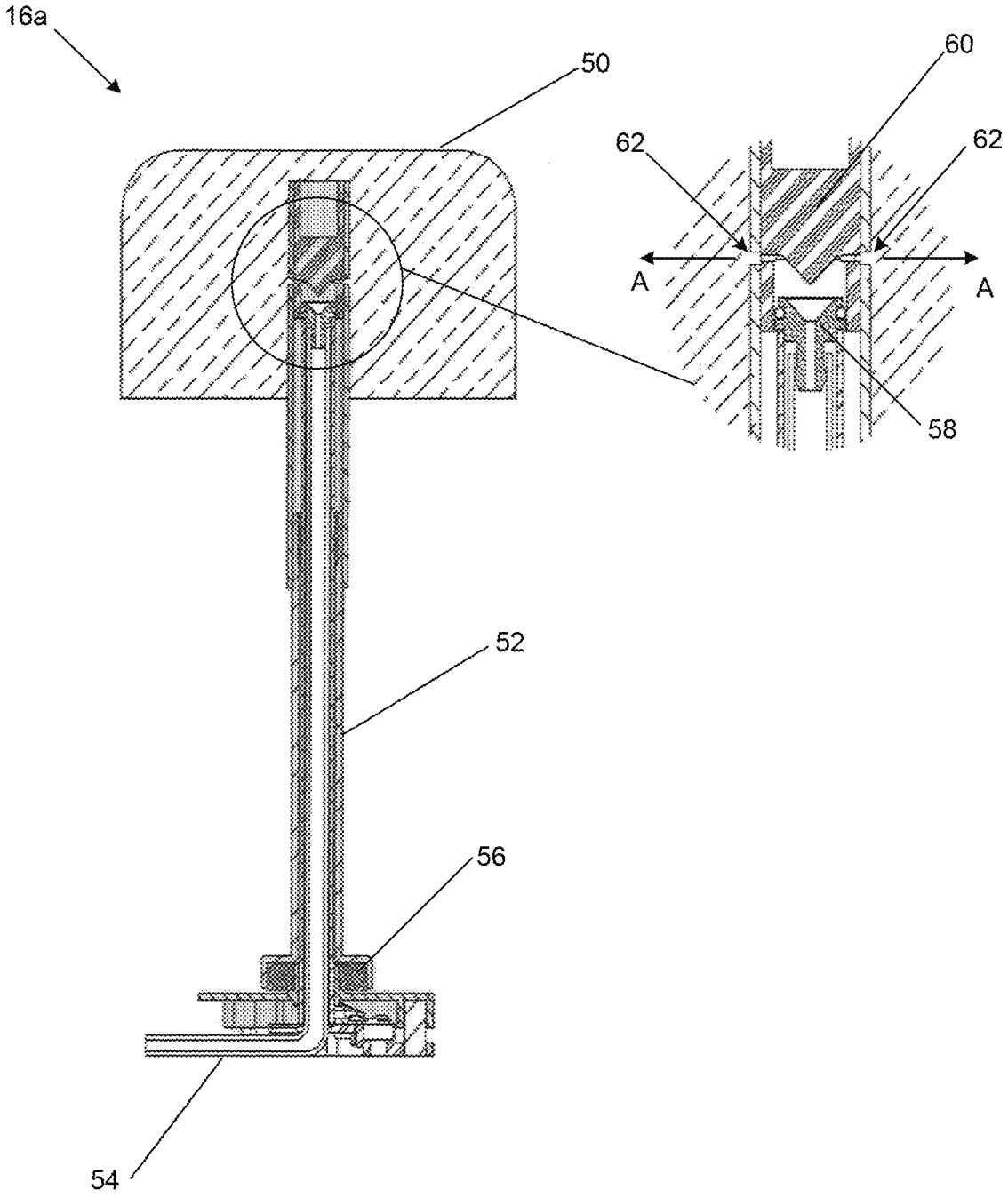
FIG. 12 is a side sectional view of another shaft.

FIG. 12 illustrates a switched cleaning element 16*a* in further detail. It will be appreciated that cleaning element 16*c* may be similarly configured. Again, cleaning element 16*a* includes a cleaning head 50 for engaging the item to be polished, in this case a glass. The cleaning head 50 is formed of flexible filaments, which may be cotton, that are urged outwardly during rotation. In other embodiments, the cleaning elements may be formed of other materials, such as plastic foams for example. The cleaning head 50 is mounted on a shaft 52 that rotates about steam pipe 54. A bearing 56 may be provided to support the shaft 52.

Again, at the top of the steam pipe 54 is a nozzle 58 that directs steam onto a conical diffuser 60, which rotates with the cleaning head 50, for directing steam radially outwardly along path A from the steam pipe 54 via apertures 62 formed in the steam pipe 54. Steam flows through apertures 62 and into cleaning head 50 to facilitate drying and polishing of the glass. Although a single set of apertures is provided at a mid point of the cleaning element, it will be appreciated that they may be offset from the mid point, and that more that one set of apertures may be provided.

Figure 14:
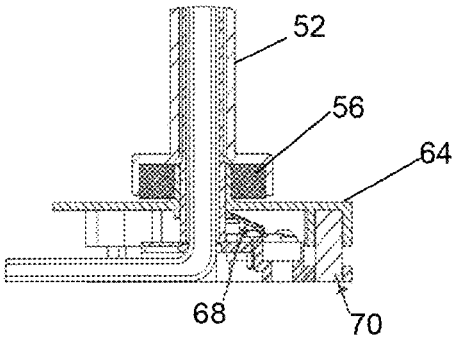
FIG. 14 is a side sectional view of another base.
Figure 15:
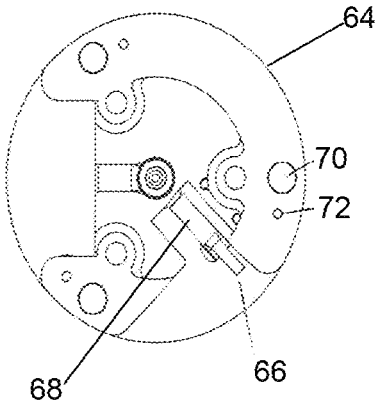
FIG. 15 is a bottom view of the base.

With switched cleaning elements 16*a*, 16*c*, the steam distribution system 34 is operable by applying pressure to the cleaning element 16*a* via the cleaning head 50 axially along the axis of rotation of the cleaning element 16*a* to trigger steam flow to all of the cleaning elements in the first set, i.e. 16*a*, 16*b*, 16*c*, 16*d*, 16*e*. FIGS. 14 and 15 illustrate how this is achieved. In this regard, a base plate 64 is provided, the base plate 64 being movable axially along the steam pipe 54 when shaft 52 is depressed. A switch 66 is provided between the base plate 64 and a base of the device 10, whereby applying pressure to the cleaning head 50 causes depression of a switch arm 68 and activation of switch 66, triggering control valve 44*b* to be opened so that steam can flow toward cleaning elements 16*a*, 16*b*, 16*c*, 16*d*, 16*e*.

A spring 70 is provided to resiliently bias the base plate 64 and thus the shaft 52 and cleaning head 50 upwardly, though allow it to be movable downwardly to operate the steam distribution system. A bolt 72 is provided for guiding movement of the brush.

Cleaning elements 16*f*, 16*g*, which are configured to dry and polish cutlery, may be unswitched cleaning elements and configured in accordance with cleaning elements 16*b*, 16*d*, 16*e*, as described above. Operation of the steam distribution system 34 for flow of steam to cleaning elements 16*f*, 16*g* via control valve 44*a* may be via a further sensor within the enclosure, such as a proximity sensor to detect the insertion of cutlery, to provide autonomous activation of steam once a piece of cutlery is inserted to hygienically clean/polish the piece of cutlery prior to use. Alternatively, an external switch on or remote from the device 10 may be provided.

The device 10 also includes a programmable microprocessor that can control operation, monitor performance parameters, and log usage data. In one example, the microprocessor can record usage history and provide alerts for replacement of the cleaning elements 16 once a predetermined number of cycles have passed. In other examples, the microprocessor may accept signals from sensors fitted to the device, such as vibration sensors to alert to damage of cleaning elements, which could shut down or limit operation of the device, or moisture sensors to alert to excessive use of steam, which could trigger operation of a heater provided within the enclosure for drying the cleaning elements.

The embodiments have been described by way of example only and modifications are possible within the scope of the invention disclosed. For example, in the illustrated embodiments, the cleaning elements 16 are rotatable for cleaning or polishing the items. In other embodiments, the direction of motion may change rapidly with the cleaning elements 16 oscillating. In other embodiments, the cleaning elements may also demonstrate axial movement, or combinations or rotation, oscillation and axial translation. Furthermore, although the cleaning elements are described as being formed of flexible filaments that are urged outwardly during rotation, they may also be formed of other materials, such as plastic foams for example.

The claims defining the invention are as follows:

1. A device for drying and polishing items such as glasses and cutlery, the device including:

an enclosure having apertures through which an end of the items can be inserted;

a plurality of movable cleaning elements within the enclosure for drying and/or polishing the items; and a selectively operable steam distribution system for applying steam within the enclosure to at least one of the cleaning elements and the items, wherein the cleaning elements dry and/or polish the items, wherein the steam distribution system is operable upon the end of at least one of the items being brought into contact with at least one cleaning element within the enclosure.

2. A device according to claim 1, wherein the cleaning elements are rotatable for cleaning or polishing the items.

3. A device according to claim 2, wherein the steam distribution system is operable by applying pressure to the cleaning elements axially along an axis of rotation of the cleaning elements.

4. A device according to claim 3, wherein at least one of the cleaning elements is mounted on a rotatable shaft, the shaft rotating around a steam pipe extending through the shaft and terminating at a steam nozzle formed by apertures in the shaft intermediate of a length of the shaft.

5. A device according to claim 4, wherein a conical diffuser is disposed at an end of the steam pipe to direct steam radially outwardly from the steam pipe and into the cleaning element.

6. A device according to claim 1, wherein the steam distribution system is operable on applying pressure to at least one of the cleaning elements via applying pressure to the item once inserted within the enclosure.

7. A device according to claim 1, wherein the cleaning elements are belt driven with multiple cleaning elements being driven by the same belt.

8. A device according to claim 1, wherein the cleaning elements are formed of flexible filaments that are urged outwardly during rotation.

9. A device according to claim 1, having an openable cover in which the apertures are formed, the device being configured to cease operation on opening of the cover.

10. A device according to claim 1, further including a flow limiter to limit the amount of steam that can be applied within the enclosure.

11. A device according to claim 1, further including a heater within the enclosure for drying the cleaning elements.

12. A device according to claim 1, further including a programmable microprocessor, wherein the microprocessor is configured to record usage history and provide alerts for replacement of the cleaning elements once a predetermined number of cycles have passed.

13. A device according to claim 1, further including a removable rubber tray received in a base of the enclosure for collecting debris.

14. A device according to claim 1, wherein the apertures through which the end of the items can be inserted comprise a first aperture for receiving glassware and a second aperture for receiving cutlery.

15. A device according to claim 1, wherein the movable cleaning elements comprise a first set of cleaning elements for drying and/or polishing glassware, and a second set of cleaning elements for drying and/or polishing cutlery.

16. A device for drying and polishing items such as glasses and cutlery, the device including:

an enclosure having apertures through which an end of the items can be inserted;

a plurality of movable cleaning elements within the enclosure for drying and/or polishing the items; and a selectively operable steam distribution system for applying steam within the enclosure to at least one of the cleaning elements and the items, wherein the cleaning elements dry and/or polish the items, wherein at least one of the cleaning elements is mounted on a rotatable shaft, the shaft rotating around a steam pipe extending through the shaft and terminating at a steam nozzle formed by apertures in the shaft intermediate of a length of the shaft, and wherein a conical diffuser is disposed at an end of the steam pipe and within the cleaning element to direct steam radially outwardly from the steam pipe and into the cleaning element.

17. A device according to claim 16, wherein the steam distribution system is operable by applying pressure to the cleaning elements axially along an axis of rotation of the cleaning elements.

18. A device according to claim 16, wherein the rotatable shaft is axially movable with respect to the steam pipe to operate the steam distribution system.

19. A device according to claim 18, wherein the rotatable shaft is resiliency biased upwardly and movable downwardly to operate the steam distribution system.

* * * * *